US005181042A

United States Patent [19]

Kaise et al.

[11] Patent Number: 5,181,042

[45] Date of Patent: Jan. 19, 1993

[54] MICROSTRIP ARRAY ANTENNA

[75] Inventors: Atsushi Kaise; Naoya Hirohara, both of Ohmiya; Hiroshi Kasahara, Kawaguchi; Iichi Wakou, Ohmiya; Yoichi Kaneko, Tokorozawa, all of Japan

[73] Assignee: Yagi Antenna Co., Ltd., Tokyo, Japan

[21] Appl. No.: 745,272

[22] Filed: Aug. 12, 1991

Related U.S. Application Data

[63] Continuation of Ser. No. 341,767, Apr. 21, 1989, abandoned.

[30] Foreign Application Priority Data

May 13, 1988 [JP] Japan ..... 63-116360
Jun. 24, 1988 [JP] Japan ..... 63-156530

[51] Int. Cl.[5] ..... H01Q 1/38; H01Q 21/06
[52] U.S. Cl. ..... 343/700 MS; 343/872
[58] Field of Search ..... 343/700 MS, 829, 846, 343/872

[56] References Cited

U.S. PATENT DOCUMENTS

| | | | |
|---|---|---|---|
| 4,477,813 | 10/1984 | Weiss | 343/700 MS |
| 4,543,579 | 9/1985 | Teshirogi | 343/365 |
| 4,697,189 | 9/1987 | Ness | 343/700 MS |
| 4,758,843 | 7/1988 | Agrawal et al. | 343/700 MS |
| 4,761,653 | 8/1988 | Owens et al. | 343/700 MS |
| 4,761,654 | 8/1988 | Zaghloul | 343/700 MS |
| 4,829,309 | 5/1989 | Tsukamoto et al. | 343/700 MS |
| 4,866,451 | 9/1989 | Chen | 343/700 MS |

FOREIGN PATENT DOCUMENTS

| | | | |
|---|---|---|---|
| 253128 | 1/1988 | European Pat. Off. . | |
| 271458 | 6/1988 | European Pat. Off. . | |
| 160103 | 12/1981 | Japan | 343/700 MS |
| 79713 | 5/1982 | Japan | 343/700 MS |
| 7707 | 1/1986 | Japan | 343/700 MS |
| 2046530 | 11/1980 | United Kingdom | 343/700 MS |

OTHER PUBLICATIONS

Haneishi et al., "Broadband Circularly Polarised Planar Array Composed of a Pair of Dielectric Resonator Antennas", Electronic Letters, 9th May 1985, vol. 21, No. 10.

Mailloux et al., "Microstrip Array Technology", Jan. 1981, pp. 25-37, IEEE Transactions on Antennas & Propagation, vol. AP-29.

*Primary Examiner*—Michael C. Wimer
*Attorney, Agent, or Firm*—Joseph Scafetta, Jr.

[57] ABSTRACT

A planar microstrip array antenna with a beam tilt, which comprises a plurality of pairs of circularly polarized wave radiating elements, the orientation angles of the two radiating elements in each pair being different by a predetermined angle within the plane of the planar antenna. The antenna further comprises a feed line for supplying electric power to the radiating elements. The feed line is provided with a plurality of pairs of terminal feeding portions which diverge corresponding individually to the pairs of circularly polarized wave radiating elements. The paired feeding portions are equal in electrical length. Since the respective orientation angles of the paired radiating elements are different, a phase difference is produced between the radiating elements, thus providing a beam tilt. Since no phase shift portion for producing a phase difference is formed between the paired terminal feeding portions, the configuration of the feed line is simple.

3 Claims, 8 Drawing Sheets

MICROSTRIP ARRAY ANTENNA

This is a continuation of U.S. patent application Ser. No. 07/341,767, filed Apr. 21, 1989, now abandoned.

BACKGROUND OF THE INVENTION

1. Field of the Invention

The present invention relates to a planar microstrip array antenna, and more specifically, to a microstrip array antenna for household use, adapted to receive electromagnetic waves from a broadcast satellite.

2. Description of the Related Art

Conventionally, a parabolic antenna has been used to receive electromagnetic waves transmitted from a broadcast satellite. It is mounted on the roof or balcony of a building so as to be directed to the satellite. The parabolic antenna comprises a reflector, a radiating element, and a converter, the last two being disposed on the focal position of the reflector. Thus, an antenna of this type has a complicated construction, and is large and heavy. In strong winds, such as those of a typhoon, therefore, the parabolic antenna may quite possibly be broken. In snowy areas, moreover, snow may accumulate on the antenna, whereby the electromagnetic waves will be absorbed in it. The installation of the parabolic antenna, furthermore, spoils the external appearance of the building.

Besides the parabolic antenna described above, a planar microstrip array antenna is adapted to receive electromagnetic waves in a frequency band available for broadcast satellites, e.g., a band of about 12 GHz. Since this planar antenna can be mounted along the wall, or the like, of a building, it is less influenced by strong winds, and is less likely to spoil the external appearance of the building.

However, the direction of a beam radiated from the conventional planar microstrip array antenna of this type is perpendicular to the plane direction of the antenna. As shown in FIG. 1, therefore, planar antenna 1 is inclined if it is directed towards broadcast satellite 3. Accordingly, antenna 1 becomes susceptible to strong winds, and snow may accumulate on it, resulting in attenuation of the electromagnetic waves from the broadcast satellite. If the planar antenna is mounted aslant in this manner, moreover, it spoils the external appearance of building 2.

In order to eliminate such an awkward situation, the planar antenna is preferably given a beam tilt or a characteristic such that a beam radiated from the antenna is deviated from a direction perpendicular to the plane of the antenna. In typical latitudes in Japan, planar antenna 1 can be mounted substantially vertically along the wall of building 2, as shown in FIG. 2, by giving the antenna an upward beam tilt of 23°, for example. By installing antenna 1 in this way, the influence of strong winds can be reduced, snow can be prevented from accumulating on the antenna, and the effect on the appearance of building 2 can be lessened.

The aforesaid beam tilt can be obtained by giving phase differences to a plurality of radiating elements which constitute an array. FIGS. 3 and 4 show part of the prior art planar microstrip array antenna for circularly polarized waves, constructed as follows. FIG. 3 is a partial plan view of the antenna, and FIG. 4 is a sectional view taken along line 4—4 of FIG. 3. This antenna is formed by superposing first and second printed boards 7 and 8 on earth plate 5, with dielectric layers 6 between them. Feed line 9 with a predetermined pattern is formed on first printed board 7, while a conductor film is deposited on second printed board 8. Part of the conductor film is removed so that a plurality of radiation slots 10 are formed, each with a portion of the conductor film left in the center thereof, thus forming feeding patch 11. Slots 10 and patches 11 constitute a plurality of radiating elements 13*a* to 13*d*. Feed line 9 is coupled electromagnetically to feeding patches 11 of the radiating elements. Phase shift portions 12 are formed in the middle of the feed line, whereby a phase delay is caused between each two adjacent radiating elements. This phase delay is adjusted to, e.g., a quarter of wavelength $\lambda g$ of electromagnetic waves to be propagated. In this arrangement, the beam tilt of about 23° can be given to the antenna.

In order to maximize the antenna efficiency of the planar microstrip array antenna constructed in this manner, the distance between each two adjacent radiating elements must be set to 80 to 90% of wavelength $\lambda o$ of electromagnetic waves in a free space. In the array antenna with the aforementioned beam tilt, moreover, substantial electromagnetic radiations or grating lobes are inevitably produced in undesired directions. In order to prevent these grating lobes, distance d between the radiating elements in each pair to be given a phase difference must be set to, e.g., $0.64\lambda o$ or less. If the array antenna is designed so as to be best suited for the 12-GHz band, the frequency band for broadcasting via satellite, for example, in consideration of these requirements, the outside diameter of radiating slot 10 of each radiating element is about 14 mm, and distance d is about 16 mm. Accordingly, the gap between the outer peripheral edges of the respective radiating slots of each pair of radiating elements to be given the phase difference is about 2 mm, which is not a very wide space. Since phase shift portions 12 are formed in the middle of the terminal portions of feed line 9, moreover, the configuration of the feed line is complicated. At such portions as those indicated by symbols A, B and C in FIG. 3, therefore, the feed line is situated so close to the radiating elements that undesired electromagnetic coupling are caused between them, thus lowering the gain of the antenna. If the width of the feed line is reduced to enlarge the distance between the feed line and the radiating elements, in order to prevent these undesired electromagnetic coupling, a great loss is produced in the feed line, so that the antenna gain is lowered.

As described above, the conventional planar array antenna with a beam tilt entails reduced gain. If the configuration of the feed line is thus complicated, moreover, the phase is asymmetrical at the diverging and bent portions. Accordingly, impedance matching is difficult, and again, the gain is lowered.

SUMMARY OF THE INVENTION

The object of the present invention is to give a beam tilt to a planar microstrip array antenna, and to prevent lowering of the gain and characteristics of the antenna.

In order to achieve the above object, according to the present invention, each pair of radiating elements for circularly polarized waves are arranged at a predetermined rotational angle to each other within the plane of a planar antenna. Terminal feeding portions of a feed line, which correspond individually to the radiating elements in pairs, are formed so that their electrical lengths, as measured from their diverging portions, are equal. With this arrangement, phase shifts are produced between the paired radiating elements, thus permitting a desired beam tilt. According to the present invention, moreover, phase shift portions need not be formed in the middle of the terminal feeding portions of the feed line which correspond to the radiating elements, so that the general configuration of the feed line is simple. Consequently, the gap between the feed line and the radiating elements can be made wide enough to prevent undesired electromagnetic coupling between the feeder line and the elements, thus ensuring improvement in the gain and characteristics of the antenna.

According to an aspect of the present invention, furthermore, the external configuration of each radiating element situated close to the feed line is partially modified so that the gap between the element and the line is widened. In this arrangement, although the characteristics of the radiating elements themselves are lowered, the undesired electromagnetic coupling between the elements and the feed line are reduced, so that the gain and characteristics of the antenna, as a whole, are improved.

BRIEF DESCRIPTION OF THE DRAWINGS

The present invention will be apparent in the following detailed description of illustrative embodiments thereof which is to be read in connection with the accompanying drawings, in which.

DETAILED DESCRIPTION OF THE PREFERRED EMBODIMENTS

Figure 5:
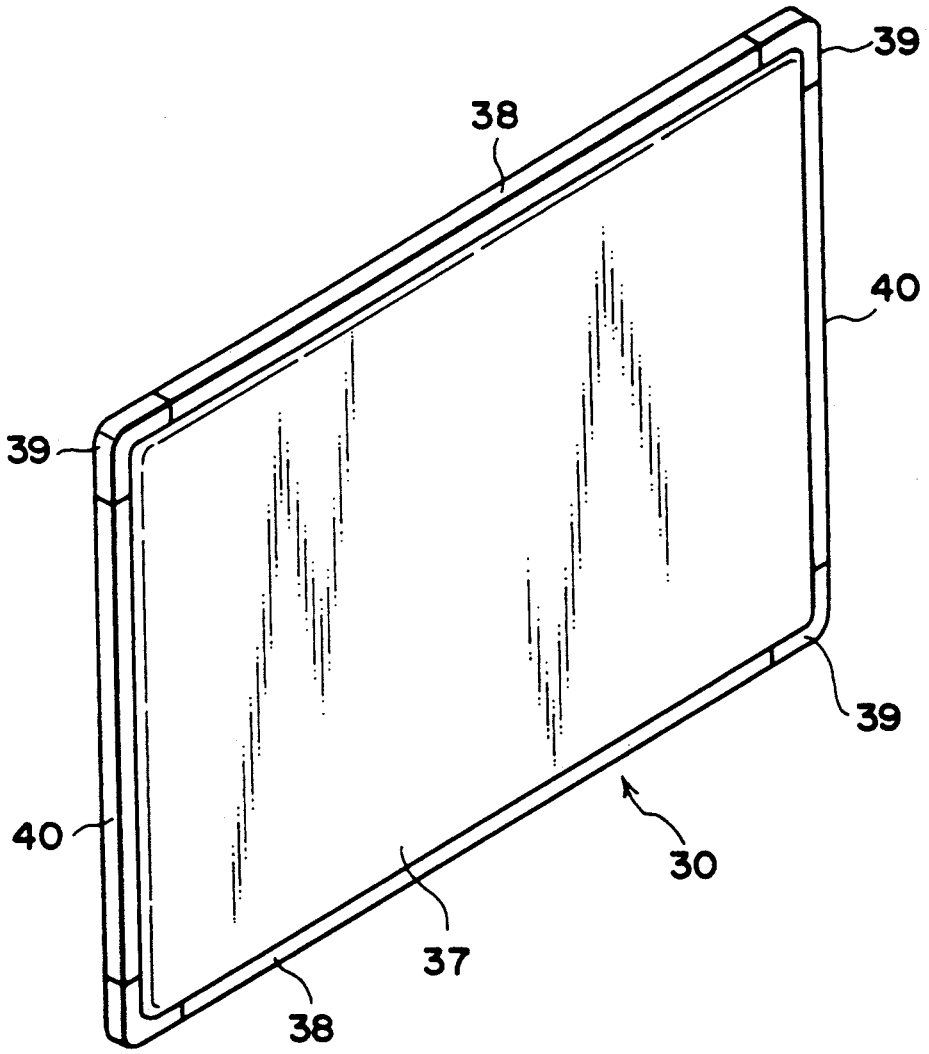
FIG. 5 is a perspective view showing an outline of a planar microstrip array antenna according to a first embodiment of the present invention.
Figure 6:
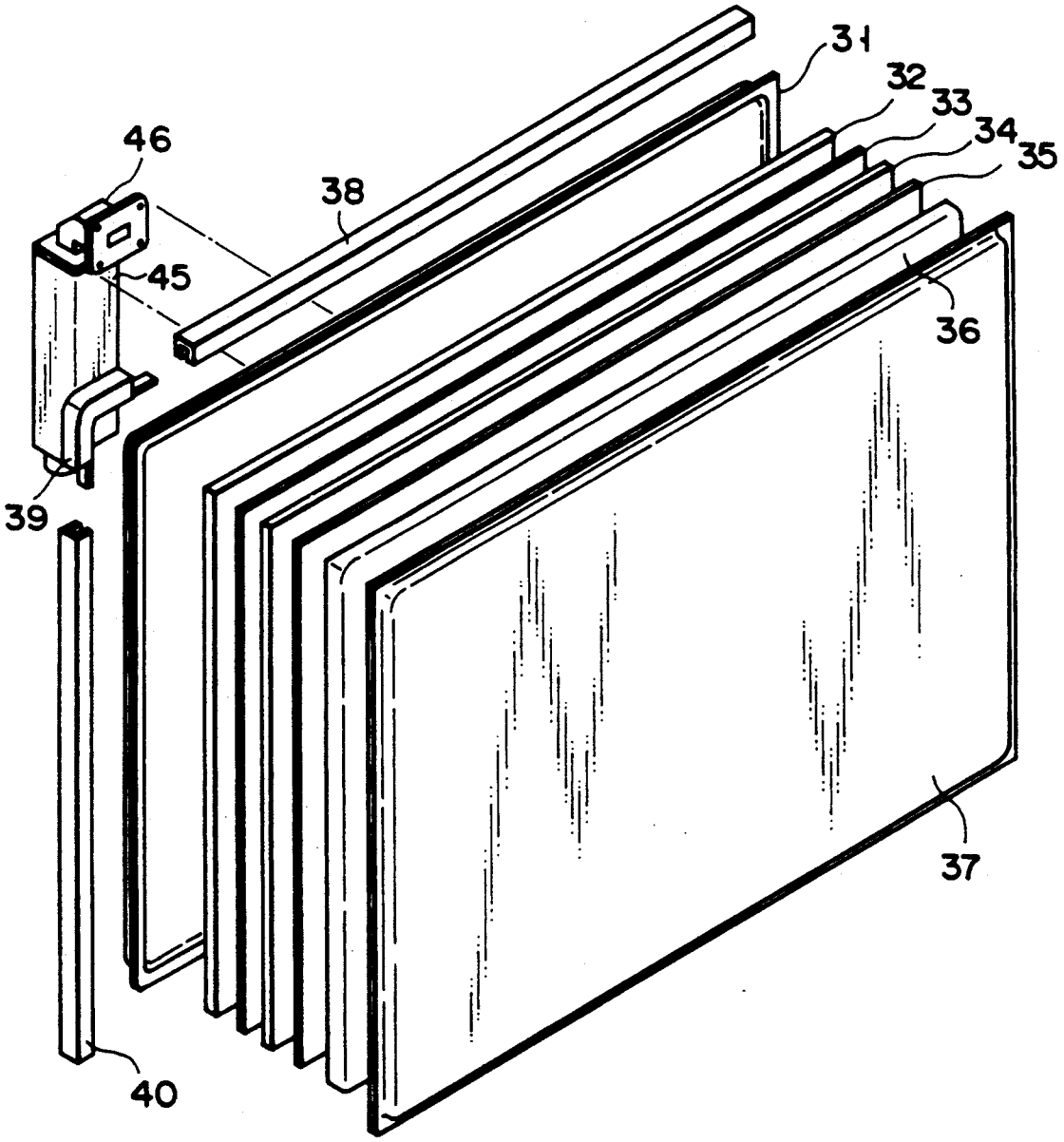
FIG. 6 is an exploded perspective view of the antenna shown in FIG. 5.

FIGS. 5 to 10 show a first embodiment of the present invention. Antenna 30 of this embodiment is a planar microstrip array antenna for circularly polarized waves. FIG. 5 shows an outline of antenna 30, and FIG. 6 is an exploded perspective view of the antenna. Antenna 30 comprises metallic body 31 in the form of a shallow tray, that is, a rectangular plate with a peripheral flange, which doubles as an earth plate. First dielectric sheet 32, printed feeder board 33, second dielectric sheet 34, printed radiation board 35, protector plate 36, and cover 37 are successively superposed in layers on the front face of body 31. The respective edge portions of cover 37 and body 31 are coupled together by means of frame members 38, 39 and 40, whereby the aforesaid individual members are assembled together. First and second dielectric sheets 32 and 34 are formed of dielectric material, e.g., foaming polyethylene. Cover 37 is formed of synthetic resin or fiber-reinforced plastic material. Preferably, the surface of cover 37 is coated with a film, such as fluorine-based resin or "TEDLER" film (trademark; produced by Du Pont de Nemours & Co., USA), which is highly weatherproof, sheds water, and cannot be easily soiled with snow, ice, or dirt. Protector plate 36 is formed relatively thick from highly adiabatic material, such as foaming polystyrene. Plate 36 serves to protect printed radiation board 35 and the like from a temperature rise caused by sunlight, and to prevent them from being mechanically damaged when some hard substance runs against cover 37.

Converter 45 is attached to the rear face of body 31. It is coupled electromagnetically to printed feeder board 33 by means of feed waveguide 46. Waveguide 46 is bent at an angle of 90° so that converter 45 is disposed parallel to the rear face of body 31. With this arrangement, the depth of the whole antenna structure can be reduced.

Figure 7:
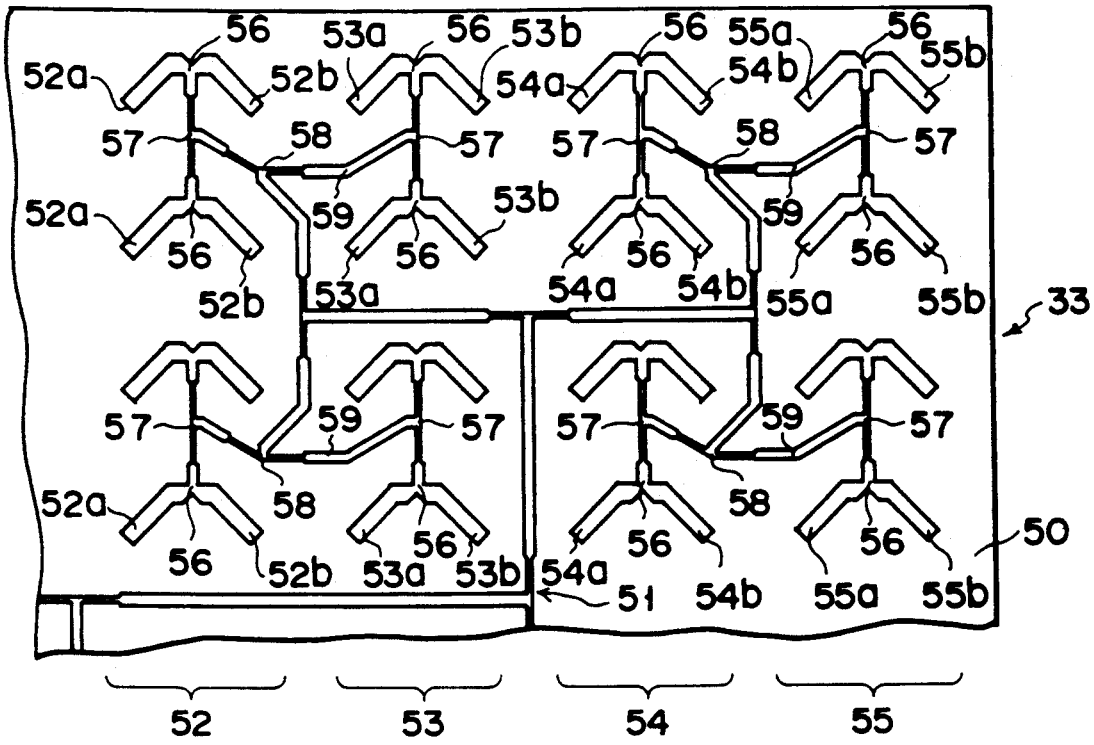
FIG. 7 is a partial plan view of a printed feeder board.
Figure 8:
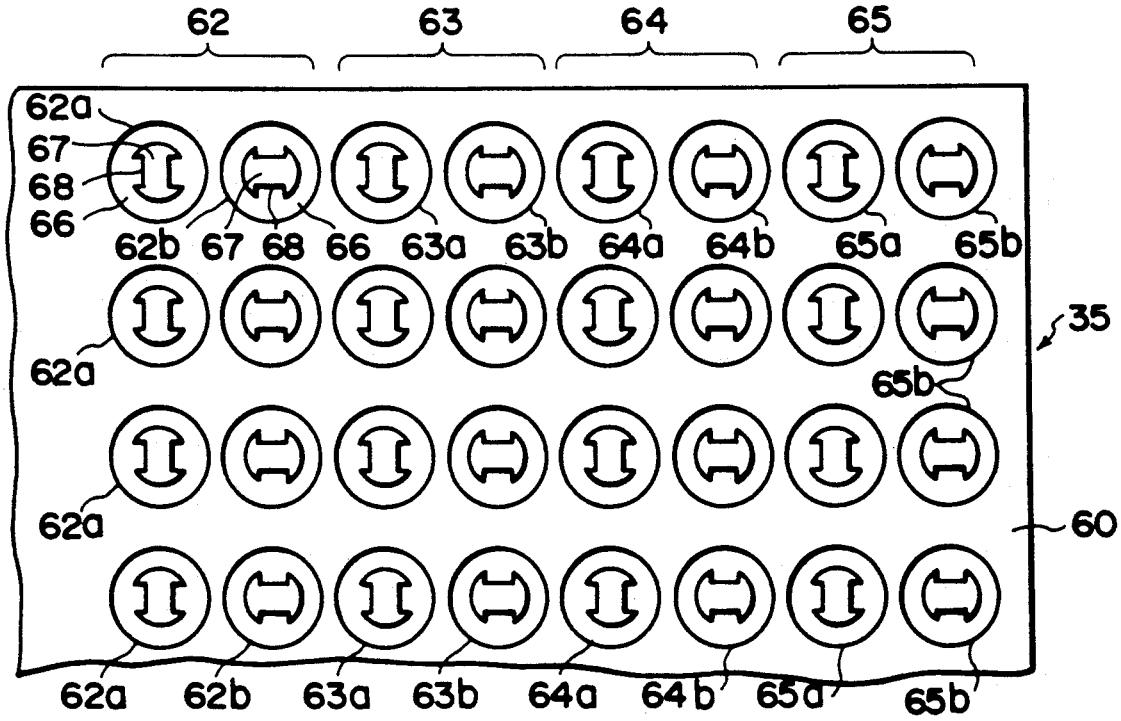
FIG. 8 is a partial plan view of a printed radiation board.
Figure 9:
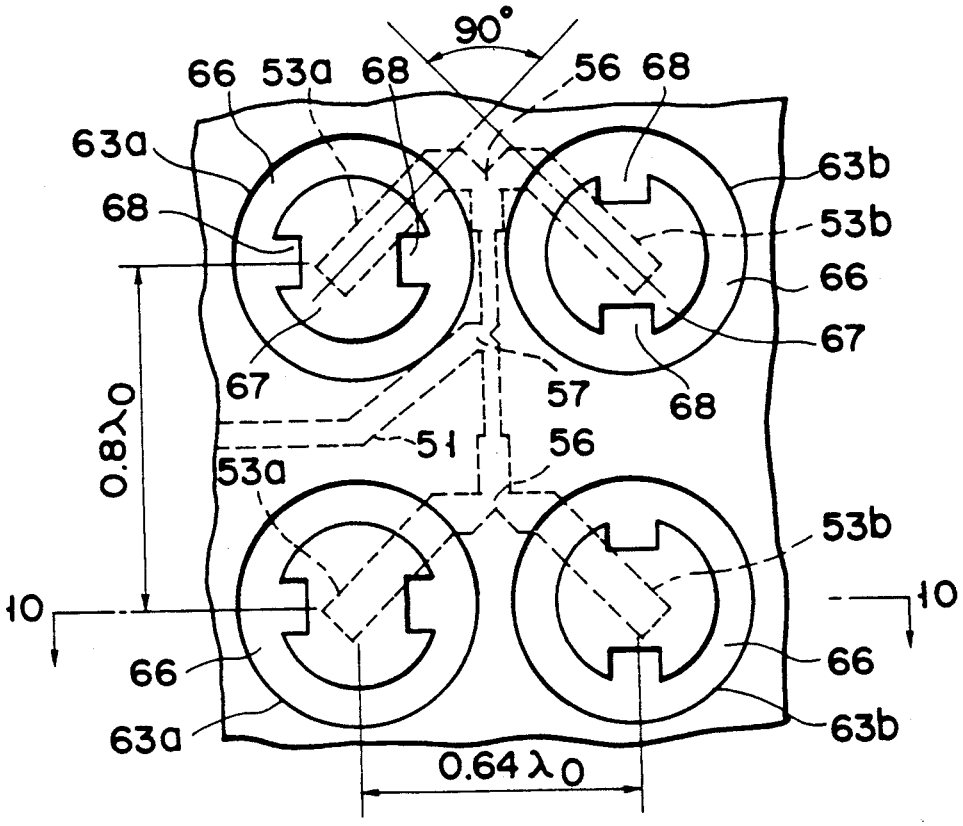
FIG. 9 is a plan view showing the positional relationships between superposed radiating elements and a feed line.
Figure 10:
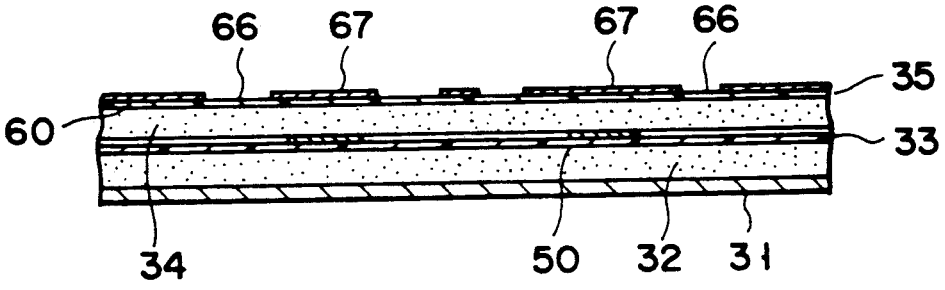
FIG. 10 is a sectional view taken along line 10—10 of FIG. 9.

FIGS. 7 and 8 show the arrangements of printed feeder board 33 and printed radiation board 35, respectively. In feeder board 33, feed line 51, composed of a conductor film having the pattern shown in FIG. 7, is formed on dielectric film substrate 50. As shown in FIG. 8, on the other hand, a plurality of pairs of circularly polarized wave radiating elements **62*a* to 65*a* and 62*b* to 65*b* are arranged on radiation board 35. Each of these radiating elements is composed of annular radiating slot 66 and substantially circular feeding patch 67. Slot 66 is formed by annularly removing part of the conductor film on dielectric film 60 so that patch 67 of the conductor film is left in the center. A pair of notches 68 are formed on the peripheral edge portion of patch 67 so as to diametrically face each other. Further, a plurality of pairs of terminal feeding portions 52*a* to 55*a* and 52*b* to 55*b* are formed on feed line 51 of feeder board 33, corresponding individually to the radiating elements. As shown in FIGS. 9 and 10, printed boards 33 and 35 are superposed with second dielectric sheet 34 between them. The feeding portions are coupled electromagnetically to their corresponding radiating elements so as to correspond to the lower portions of the respective feeding patches of the elements. More specifically, first pairs 52 of terminal feeding portions 52*a* and 52*b* are coupled to first pairs 62 of radiating elements 62*a* and 62*b*, respectively; second pairs 53 of portions 53*a* and 53*b* to second pairs 63 of elements 63*a* and 63*b*, third pairs 54 of portions 54*a* and 54*b* to third pairs 64 of elements 64*a* and 64*b*, and fourth pairs 55 of portions 55*a* and 55*b* to fourth pairs 65 of elements 65*a* and 65*b*. Each pair of terminal feeding portions are connected by means of first diverging portion 56, and each two adjacent pairs are connected by means of their respective second diverging portions 57. First and second pairs 52 and 53 and third and fourth pairs 54 and 55 are connected by means of their corresponding third diverging portions 58. Each pair of radiating elements are arranged at a rotational angle of 90° to each other within the plane of the antenna. More specifically, elements 62b, 63b, 64b and 65b of first, second, third, and fourth pairs 62, 63, 64 and 65 are oriented at an angle of 90° to elements 62a, 63a, 64a and 65a, respectively. Also, the terminal feeding portions are oriented corresponding to the arrangement of the radiating elements. More specifically, portions 52b, 53b, 54b and 55b of first, second, third, and fourth pairs 52, 53, 54 and 55 are oriented at an angle of 90° to portions 52a, 53a, 54a and 55a, respectively. Notches 68 of each radiating element are arranged at an angle of 45° to the extending direction of each terminal feeding portion. As shown in FIG. 8, the elements of adjacent pairs, for example elements 62a and 62b of a first pair and the elements 63a and 63b** of a second pair, are arranged in straight line relation to one another. Electromagnetic-wave beams of right-handed circularly polarized waves are emitted from the radiating elements.

A phase shift of 90° is made between each pair of radiating elements, that is, between elements 62a and 62b, between elements 63a and 63b, between elements 64a and 64b, and between elements 65a and 65b. The individual terminal feeding portions of the feed line have the, same electrical length, and the electrical distance between of the additional feeding portions first and second diverging portions 56 and 57 is uniform. Phase shift portions 59 are formed individually in the ones of the further additional feeding portions between second and third diverging portions 57 and 58 of each second pair 53 and between second and third diverging portions 57 and 58 of each fourth pair 55. Portions 59 produce a phase delay of 180° each. Accordingly, radiating elements 62b, 63a and 63b are subject to phase delays of 90°, 180°, and 270°, respectively, behind each corresponding radiating element 62a. Likewise, elements 64b, 65a and 65b are subject to phase delays of 90°, 180°, and 270°, respectively, behind each corresponding element 64a. Elements 62a and 64a are in the same phase, that is, the former is subject to a phase delay of 360° behind the latter. Since element 63b is subject to a phase delay of 270° behind element 62a, a phase delay of 90° is produced between elements 63b and 64a. Thus, there is a phase delay of 90° between each two adjacent radiating elements. A beam tilt is produced by the phase shifts between these adjacent radiating elements. If the wavelength of the electromagnetic waves within a free space, the rotational angle between each two adjacent radiating elements, and the distance between each two adjacent radiating elements are $\lambda o$, $\alpha°$, and d, respectively, beam tilt angle $\theta°$ is given by $$\theta° \approx \sin^{-1}(\alpha° \lambda o / 2\pi d).$$

In the embodiment described above, $\alpha = 90°$ and $d = 0.64\lambda o$ are given. In this case, beam tilt angle $\theta°$ is about 23°.

FIGS. 7 and 8 only partially show printed feeder board 33 and printed radiation board 35. For other portions not shown, the feeder line and radiating elements are formed having the same pattern as aforesaid.

In this embodiment, moreover, the distance between each two adjacent radiating elements with a phase shift (e.g., between 62a and 62b or between 62b and 63a) is set at about $0.64\lambda o$, and the distance between each two adjacent radiating elements in the same phase (e.g., between 62a and 62a or between 65b and 65b) is set at about $0.8\lambda o$. By setting these distances in this manner, the efficiency of the antenna can be maximized, while production of undesired grating lobes can be minimized. In this embodiment, furthermore, the impedance of feed line 51 is set at 100 ohms. The width of line 51 varies from one point to another, whereby the impedance of each radiating element is matched to the line impedance.

Figure 1:
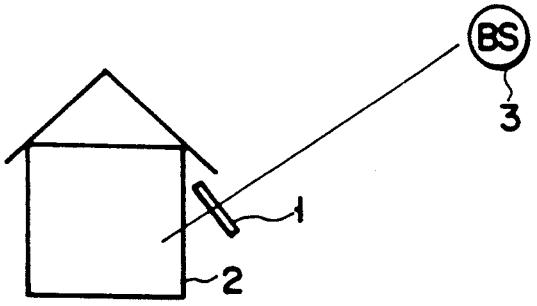
FIG. 1 (PRIOR ART)
FIG. 1 is a schematic view showing a state such that a planar antenna without a beam tilt is installed on a building.
Figure 2:
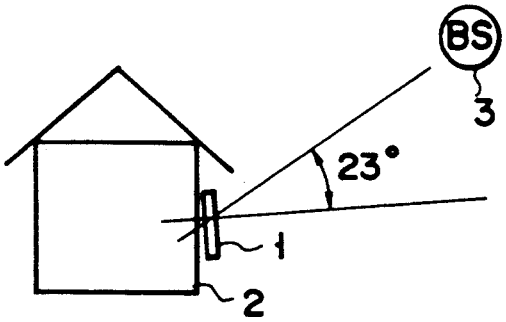
FIG. 2 (PRIOR ART)
FIG. 2 is a schematic view showing a state such that a planar antenna with a beam tilt is installed on a building.
Figure 3:
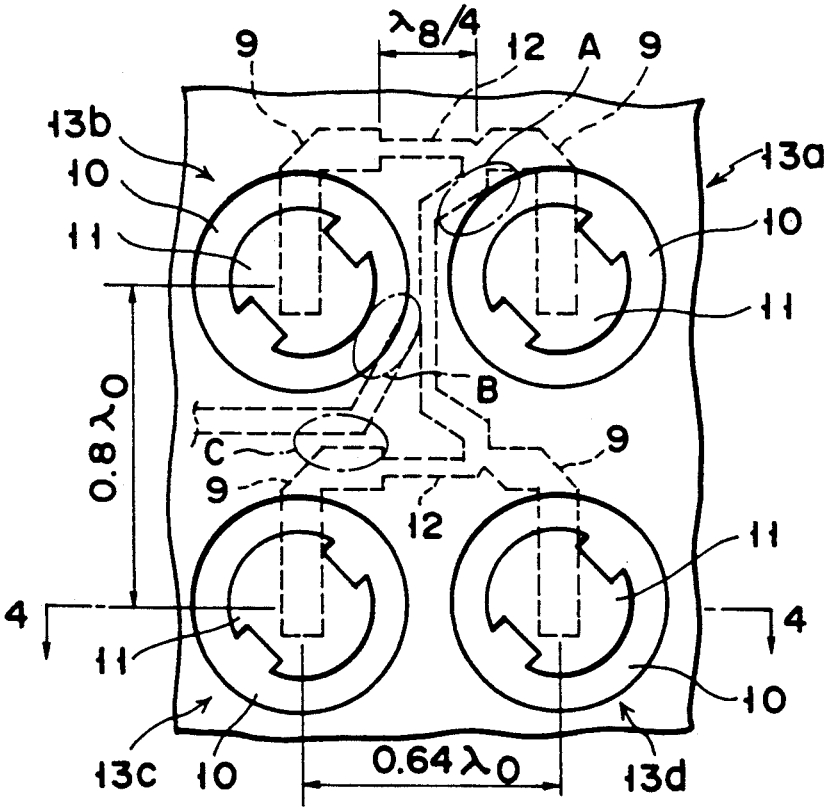
FIG. 3 (PRIOR ART)
FIG. 3 is a partial plan view of a prior art microstrip array antenna with a beam tilt.
Figure 4:
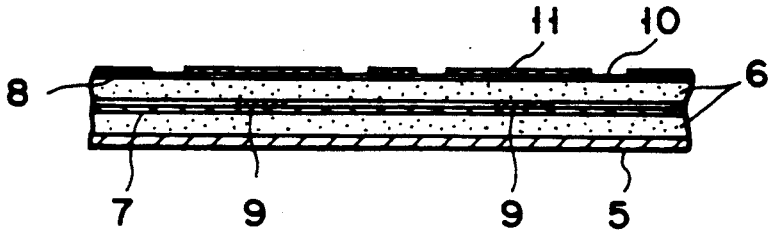
FIG. 4 (PRIOR ART)
FIG. 4 is a sectional view taken along line 4—4 of FIG. 3.
Figure 12:
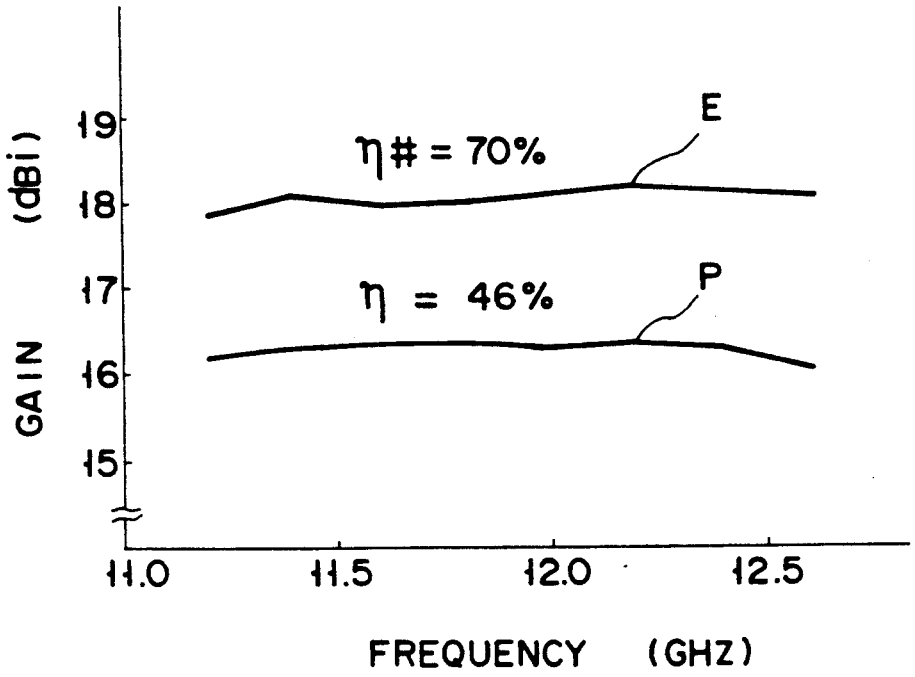
FIG. 12 shows a characteristic curve of the antenna according to the first embodiment.

FIG. 12 comparatively shows characteristic curves of the antenna according to the aforementioned embodiment and the prior art antenna. In FIG. 12, curve P represents a characteristic of the 16-element planar microstrip array antenna for the 12-GHz band, having the conventional construction shown in FIG. 3. Curve E represents a characteristic of the 16-element microstrip array antenna according to the first embodiment of the present invention shown in FIGS. 7 to 10. As seen from FIG. 12, the conventional antenna has an efficiency $\eta$ of 46%, while the antenna of the invention has 70% efficiency $\eta$. Thus, the antenna of the present invention enjoys higher efficiency than the conventional one.

Figure 11:
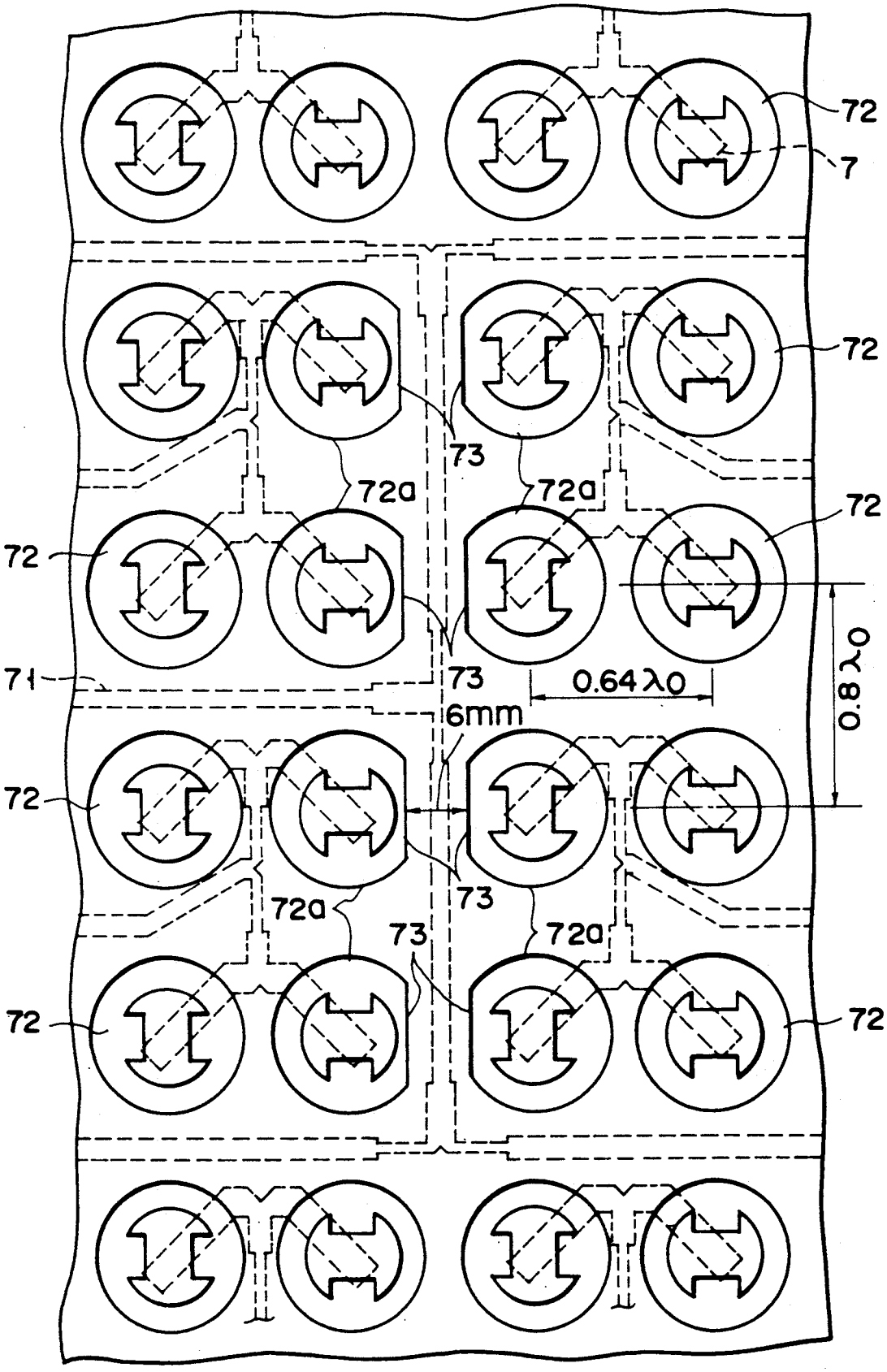
FIG. 11 is a partial plan view of an antenna according to a second embodiment of the invention.
Figure 13:
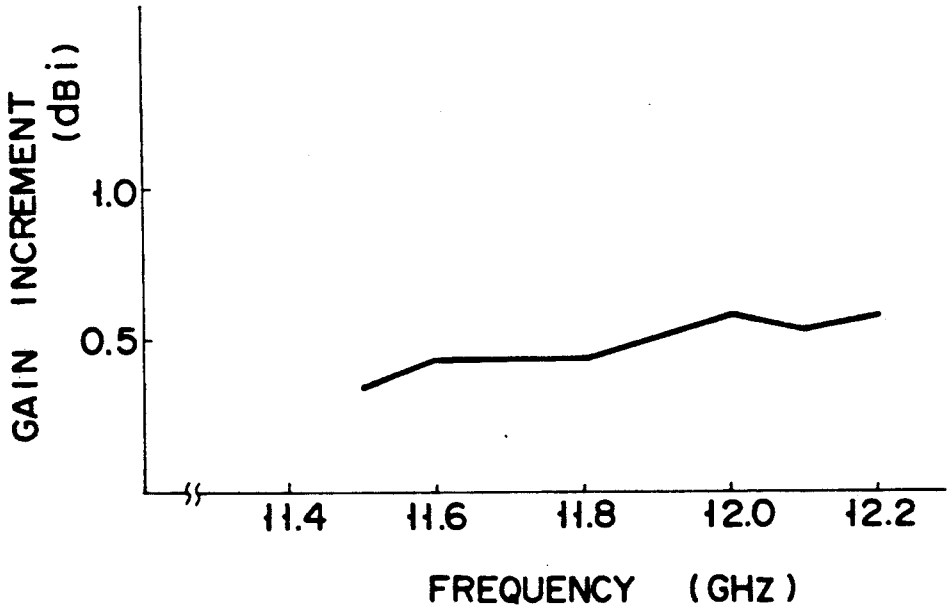
FIG. 13 shows a characteristic curve of the antenna according to the second embodiment.

FIG. 11 shows a second embodiment of the present invention. An antenna of this second embodiment has substantially the same construction as the antenna of the first embodiment shown in FIGS. 5 to 10. The second embodiment differs from the first embodiment in that the external configuration of radiating elements 72a, which, among other radiating elements 72, are situated close to feed line 71, is partially modified. More specifically, each element 72a has a straight edge 73 on one side 73 which is formed by cutting off that part of the outer peripheral edge portion of the element beside line 71. Edge 73 serves to maintain a wide gap between each element 72a and line 71. In this embodiment, the distance between the respective edges of each two adjacent elements 72a is set to, e.g., 6 mm. Although radiating elements 72a, constructed in this manner, are lower in radiation efficiency, undesired electromagnetic connections between elements 72a and feed line 71 are reduced. Thus, the whole antenna is improved in efficiency. FIG. 13 shows a characteristic curve indicative of the improvement of the efficiency of the antenna according to the second embodiment, compared to the first embodiment. As seen from FIG. 13, the gain is increased throughout the working frequency band for the antenna.

Figure 14:
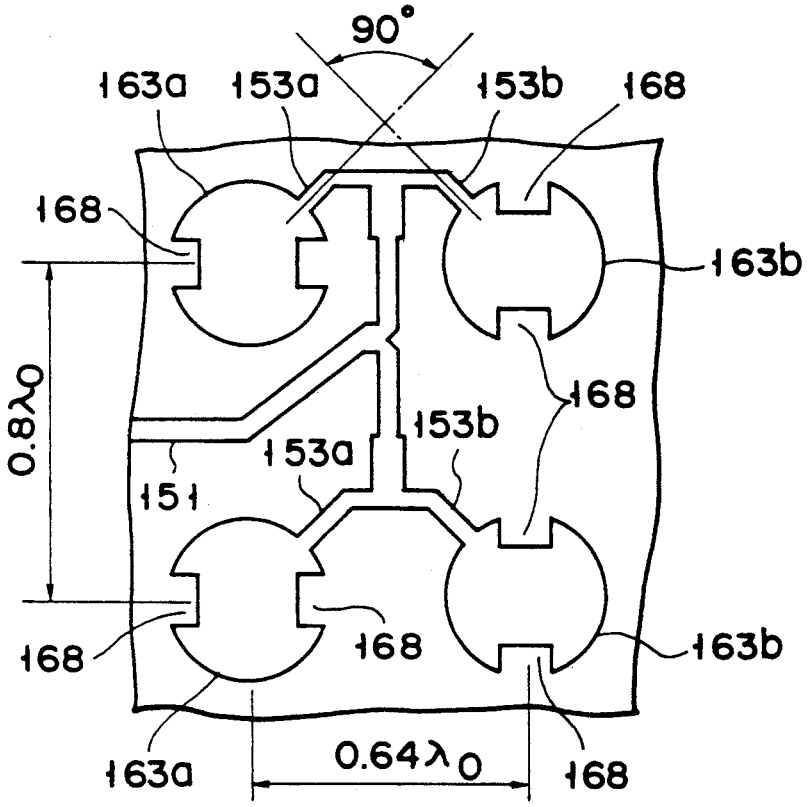
FIG. 14 is a plan view showing the positional relationships between radiating elements and a feed line according to a third embodiment of the present invention.

FIG. 14 shows a third embodiment of the present invention. In this arrangement, feed line 151 and circularly polarized wave radiating elements 163a and 163b, each composed of a radiating patch, are formed coplanarly on one and the same printed board. Elements 163a and 163b are formed having a pair of notches 168 each. Terminal feeding portions 153a and 153b of line 151 are coupled directly to radiating elements 163a and 163b, respectively. Adjacent feeding portions 153a and 153b are arranged at an angle of 90° to each other. For other arrangements, the second embodiment is constructed in the same manner as the first embodiment.

In the embodiments described above, a phase shift of 90° is given between each two adjacent circularly polarized wave radiating elements. The phase shift of this angle is best suited for antennas for the reception of broadcasting via satellite. Thus, with use of the phase difference of 90°, the phase angles of four radiating elements included in each two adjacent pairs can be set individually to 0°, 90°, 180°, and 270° by forming the feed line so that a phase difference of 180° is given between the adjacent pairs. In this case, therefore, the feed line must only be designed so as to give a phase shift of 180° between each two adjacent pairs. Thus, the feed line is simplified in construction. The phase shift of 90° results in a beam tilt of about 23°. In the temperate, the installation angle of the antenna with respect to a vertical line can be made narrow enough for practical use by giving the planar antenna the beam tilt of 23°. In Sapporo (substantially in lat. 44° N.), for example, the arrival angle (wave angle) of electromagnetic waves from a broadcast satellite in a geostationary orbit is 31.2°, so that the planar antenna can be installed at an angle of 8.2° to the vertical line. In Tokyo (substantially in lat. 36° N.), moreover, the arrival angle (wave angle) of electromagnetic waves from a broadcast satellite is 38.0°, so that the planar antenna can be installed at an angle of 15° to the vertical line. In the temperate, therefore, the planar antenna can be mounted close to and substantially along the wall of a building or the like. Thus, the possibility of the antenna being influenced by strong winds is small, snow or the like cannot accumulate on the antenna, and the installed antenna is less likely to spoil the external appearance of the building. Naturally, it is advisable to make the beam tilt angles of antennas for the high latitudes narrower, and those of antennas for the low latitudes wider. The phase difference can be selected within a range of 30° to 150° to set the beam tilt angle at will.

It is to be understood that the present invention is not limited to the embodiments described above, and that various changes and modifications may be effected therein by one skilled in the art without departing from the scope or spirit of the invention.

What is claimed is:

1. A planar microstrip array antenna with beam tilt, comprising an array, formed of a plurality of circularly polarized wave radiating elements each of which includes a circular feeding patch having a pair of diametrically opposed notches, and a feed line coupled to the radiating elements, wherein said circularly polarized wave radiating elements are grouped into a plurality of pairs, one radiating element in each said pair being oriented with respect to said notches at a rotational angle $\alpha°$ to the other radiating element, within the plane of the planar antenna;

said feed line is provided with a plurality of pairs of terminal feeding portions corresponding individually to the pairs of circularly polarized wave radiating elements, said terminal feeding portions for each said pair of radiating elements diverging individually from a first diverging portion and being equal in electrical length;

said feed line is further provided with additional feeding portions connecting the first diverging portions of adjacent pairs of radiating elements to an additional diverging portion, one of the additional feeding portions including a phase shift portion;

said angle $\alpha°$ is set so as to satisfy an equation given by $$\theta \approx \sin^{-1}(\alpha° \lambda_o / 2\pi d),$$

where $\theta$ is a desired beam tilt angle, d is the distance between the circularly polarized wave radiating elements in each pair, and $\lambda_o$ is the wavelength of electromagnetic waves within a free space; and wherein a group of radiating elements which, among said plurality of circularly polarized wave radiating elements, are situated most closely adjacent to the feed line configurations partially include straight edge portions on the sides thereof proximate to the feed line, whereby the gap between each said circularly polarized wave radiating element and the feed line is maintained.

2. A planar microstrip array antenna with beam tilt, comprising an array, formed of a plurality of circularly polarized wave radiating elements each of which includes a circular feeding patch having a pair of diametrically opposed notches, and a feed line coupled to the radiating elements, wherein said circularly polarized wave radiating elements are grouped into a plurality of pairs, one radiating element in each said pair being oriented with respect to said notches at a rotational angle $\alpha°$ to the other radiating element, within the plane of the planar antenna;

said feed line is provided with a plurality of pairs of terminal feeding portions corresponding individually to the pairs of circularly polarized wave radiating elements, said terminal feeding portions for each said pair of radiating elements diverging individually from a first diverging portion and being equal in electrical length;

said feed line is further provided with additional feeding portions connecting the first diverging portions of adjacent pairs of radiating elements to an additional diverging portion, one of the additional feeding portions including a phase shift portion;

said angle $\alpha°$ is set so as to satisfy an equation given by $$\theta \approx \sin^{-1}(\alpha° \lambda_o / 2\pi d),$$

where $\theta$ is a desired beam tilt angle, d is the distance between the circularly polarized wave radiating elements in each pair, and $\lambda_o$ is the wavelength of electromagnetic waves within a free space;

said feed line being formed on a printed feeder board so as to be coupled electromagnetically to the circularly polarized wave radiating elements;

said radiating elements being formed on a printed radiation board; and further comprising a body made of electrically conductive material in the form of a rectangular plate having a front face and a peripheral flange, and wherein a first dielectric sheet made of synthetic resin foam is superposed on the front face of the body, said printed feeder board is superposed on the first dielectric sheet, a second dielectric sheet made of synthetic resin foam is superposed on the printed feeder board, said printed radiation board is superposed on the second dielectric sheet, a protector plate made of synthetic foam is superposed on the printed radiation board, and a cover is superposed on the protector plate, the antenna further including frame means for joining the respective edge portions of said cover and said body together.

3. A planar microstrip array antenna with beam tilt, comprising an array formed of a plurality of circularly polarized wave radiating elements each of which includes a circular feeding patch having a pair of diametrically opposed notches, and a feed line coupled to the radiating elements, wherein said circularly polarized wave radiating elements are grouped into a plurality of pairs, one element of each pair being oriented with respect to said notches at a rotational angle of 90° to the other radiating element of each pair, within the plane of the planar antenna, the elements of adjacent pairs of wave radiating elements being in straight line relation to one another;

said feed line is provided with a plurality of pairs of first feeding portions corresponding respectively to the pairs of circularly polarized wave radiating elements diverging respectively from a first diverging portions, said first feeding portions being equal in electrical length;

said feed line is further provided with additional feeding portions connecting the first diverging portions of adjacent pairs of radiating elements to a second diverging portion, said additional feeding portions being equal in electrical length;

said feed line is further provided with further additional feeding portions connecting adjacent two second diverging portions to a third diverging portion, one of said further additional feeding portions including a phase shift portion for producing a phase difference of 180°.

* * * * *